US010965061B2

(12) United States Patent
Veit et al.

(10) Patent No.: US 10,965,061 B2
(45) Date of Patent: Mar. 30, 2021

(54) SECURING APPARATUS FOR MECHANICALLY SECURING AT LEAST ONE CONNECTING PLUG TO A HOUSING

(71) Applicant: Pilz GmbH & Co. KG, Ostfildern (DE)

(72) Inventors: Andreas Veit, Ostfildern (DE); Joachim Rink, Ostfildern (DE); Markus Cech, Ostfildern (DE)

(73) Assignee: Pilz GmbH & Co. KG, Ostfildern (DE)

( * ) Notice: Subject to any disclaimer, the term of this patent is extended or adjusted under 35 U.S.C. 154(b) by 0 days.

(21) Appl. No.: 16/577,320

(22) Filed: Sep. 20, 2019

(65) Prior Publication Data

US 2020/0099170 A1 Mar. 26, 2020

(30) Foreign Application Priority Data

Sep. 21, 2018 (DE) ..... 102018123324.8

(51) Int. Cl.
*H01R 13/639* (2006.01)
*H01R 13/502* (2006.01)
*H01R 13/506* (2006.01)

(52) U.S. Cl.
CPC ..... *H01R 13/639* (2013.01); *H01R 13/506* (2013.01); *H01R 13/5025* (2013.01)

(58) Field of Classification Search
CPC . H01R 13/639; H01R 13/5025; H01R 13/506
USPC ..... 439/371, 369
See application file for complete search history.

(56) References Cited

U.S. PATENT DOCUMENTS 3,638,169 A * 1/1972 Caveney ..... H01R 13/5804 439/471
4,066,313 A * 1/1978 von dem Hagen .. H01R 13/639 439/471
4,917,627 A * 4/1990 Hendricks ..... H01R 13/6272 24/665
7,140,903 B2 * 11/2006 Pulizzi ..... H01R 13/5804 439/371
7,264,497 B1 * 9/2007 Lewis ..... H01R 13/6392 439/371
7,927,126 B1 * 4/2011 Bender ..... B01J 19/081 439/369

(Continued)

FOREIGN PATENT DOCUMENTS

DE 20002654 U1 4/2000

OTHER PUBLICATIONS

Search Report in corresponding European Patent Application No. 19196768.6, dated Mar. 4, 2020, with English translation.

*Primary Examiner* — Hien D Vu
(74) *Attorney, Agent, or Firm* — Edell, Shapiro & Finnan, LLC

(57) ABSTRACT

A securing apparatus for mechanically securing at least one connecting plug to a housing is provided, where the securing apparatus contains (a) a bow-like shaped base body, where the body can slide laterally onto the housing, and be fixed to the housing, (b) at least one receiving section, which is formed on the base body and which is designed for receiving the connecting plug, and (c) a plurality of strip-shaped, tightenable securing devices, which are capable of securing the connecting plug to the base body and/or the base body to the housing.

11 Claims, 7 Drawing Sheets

(56) References Cited

U.S. PATENT DOCUMENTS

| | | | | |
|---|---|---|---|---|
| 8,613,629 | B2 * | 12/2013 | Gong | H01R 13/6395 439/371 |
| 9,147,943 | B2 | 9/2015 | Madison | |
| 2008/0299824 | A1 | 12/2008 | Legg | |

* cited by examiner

SECURING APPARATUS FOR MECHANICALLY SECURING AT LEAST ONE CONNECTING PLUG TO A HOUSING

CROSS REFERENCE TO RELATED APPLICATIONS

This application claims foreign priority under 35 U.S.C. § 119(a)-(d) to Application No. DE 102018123324.8 filed on Sep. 21, 2018, the entire contents of which are hereby incorporated by reference.

TECHNICAL FIELD

A securing apparatus for mechanically securing at least one connecting plug to a housing is provided.

BACKGROUND

Control apparatuses, in particular, safety control apparatuses, which are intended for controlling a machine or a technical system and which have a modular construction design, have previously been described. In the case of modularly constructed control apparatuses it is possible to combine, for example, various control modules of different performance classes: digital or analog, secure and/or insecure input and output modules, as well as network modules individually with one another, in order to provide the control apparatus with the control functions. These modular control apparatuses often comprise a so-called head module having connecting interfaces for connecting one or more connecting plugs. In this case such connecting plugs are, for example, so-called M12 connecting plugs. To prevent the plug connection from unintentionally disengaging when, for example, vibrations occur, it has proved to be expedient to provide appropriate securing measures that can effectively prevent an unintentional disengagement of the plug connection. When used in safety critical areas, measures to prevent tampering with the electrical plug connection are also necessary.

SUMMARY

A securing apparatus is provided for mechanically securing at least one connecting plug to a housing so that the securing apparatus provides the plug connection with reliable protection against vibration and/or tampering in a simple way.

What is provided is a securing apparatus for mechanically securing at least one connecting plug to a housing, for example, to a housing of a head module of a modular control apparatus, comprises a bow-like shaped base body, which is designed such that it can be slid laterally onto the housing and can be fixed to the housing, at least one receiving section, which is formed on the base body and is designed for receiving the connecting plug, as well as a number of strip-shaped, tightenable fasteners, which are designed to secure the connecting plug to the base body and/or to secure the base body to the housing.

The housing may be a housing of a head module of a modular control apparatus. The receiving section may be partially cylindrical and have an abutment surface for the connecting plug. The abutment surface may contain tolerance-compensating shapes and/or structures that are elastically deformable. The receiving section may have a collar portion on a free end, where the collar portion is partially annular, and optionally has an undercut.

The base body may contain two retaining rails that extend parallel to one another and that are spaced apart from one another, where the rails can slide laterally onto the housing during mounting. Projections may be formed on a front side of the housing and extending outwards in the opposite direction, engage in the retaining rails when the securing apparatus is mounted. The base body may contain an elastically pivotable latching pawl that engages a latching recess on the front side of the housing upon mounting to the securing apparatus. The base body may contain a stop face that faces away from the housing during mounting, where the stop face interacts in an adjustable manner with a strip-shaped tightenable fastener that is received in a receiving eye in the side wall of the housing. The base body may contain at least one retaining web, which is spaced apart from the front side of the housing after the base body is mounted, and which can be fixed to the at least one of the strip-shaped, tightenable fasteners, where the retaining web has an anti-slip structure on its underside such as a serrated structure.

An effective anti-vibration and/or anti-tamper protection of the electrical plug connection, which comprises the connecting plug, is achieved by using the securing apparatus as described herein in that the connecting plug is fixed to the base body of the securing apparatus, which is made of plastic, advantageously produced in one piece, in a suitable manner by at least one of the strip-shaped, tightenable fasteners. Furthermore, it is also possible in this way to effectively reduce the mechanical loads exerted on the soldering points, which are located inside the housing and are exposed to forces, acting on the connecting plug, during vibrations. Depending on their positioning, the fasteners can also form an anti-tamper protection for the connecting plug by preventing the connecting plug from being unscrewed or pulled out. Moreover, the fasteners can also prevent via their suitable positioning that the base body of the securing apparatus is removed from the housing so that in this respect the result is also an effective anti-tamper and anti-loss protection for the securing apparatus itself. The strip-shaped, tightenable fasteners may be designed, for example, as cable ties. In principle, other configurations of the strip-shaped fasteners, which, after mounting, can also be sealed as an option, are also possible. The securing apparatus is especially suitable for the mechanical securing of one or more connecting plugs, which are connected to a head module of a modularly constructed control apparatus, for example, a modularly constructed safety control apparatus. In this case the securing apparatus may be a component, which has already been pre-fabricated at the manufacturer or else may be a retrofitted part. The securing apparatus as described herein is especially suitable for securing M12 connecting plugs that may be designed so as to be straight or angled. In addition, other types of connecting plugs that are designed so as to be straight or angled may also be secured via the securing apparatus. The securing apparatus may be designed advantageously such that a connecting plug can be prevented from being plugged in and/or locked by sealing or by tightening at least one of the strip-shaped fasteners, if a connecting plug is not to be connected. As a result, an anti-tamper protection is also provided.

In order to be able to effectively absorb the forces that act on the connecting plug, in particular, the vibration-induced forces, it is proposed in one advantageous embodiment that the receiving section is formed so as to be partially cylindrical and has an abutment surface for the connecting plug.

The connecting plug may be secured directly to the receiving section advantageously via one of the strip-shaped, tightenable fasteners.

In a particularly advantageous embodiment there is the option that the abutment surface has tolerance-compensating shapes and/or structures that are designed so as to be advantageously elastically deformable. As a result, not only is an improved vibration damping provided, but also, in particular, it is possible to compensate for any existing differences in the diameter of various connecting plugs.

In order to achieve a particularly secure hold of at least one of the strip-shaped fasteners at the receiving section, it may be provided in a particular implementation that the receiving section has on a free end a collar portion, which is designed so as to be partially annular and which has advantageously an undercut. This collar portion allows the at least one strip-shaped fastener to be securely fixed to the receiving section.

In a particular implementation there is the option that the base body comprises two retaining rails that extend parallel to one another and that are spaced apart from one another such that during mounting they can be slid laterally onto the housing. As a result, the mounting of the securing apparatus, for example, on the housing of a head module, can be carried out very easily and intuitively. Furthermore, this method makes possible a simple pre-fixing of the securing apparatus to the housing. Advantageously, the retaining rails can be formed such that when the securing apparatus is mounted, projections, which are formed on a front side of the housing and which extend outwards in the opposite direction, engage in the retaining rails, advantageously in a positive locking manner.

In order to protect a securing apparatus, which has already been pre-mounted on the housing at the manufacturer, against loss, it may be provided in an advantageous further development that the base body comprises an elastically pivotable latching pawl that is designed such that it engages, in a desired mounting position of the securing apparatus, in a latching recess on the front side of the housing.

An alternative or additional variant of the anti-loss protection for the securing apparatus provides that the base body comprises on its outside, which faces away from the housing during mounting, a stop face, which interacts with a strip-shaped fastener, which is received in a receiving eye in the side wall of the housing and is tightened therein.

It is proposed in an advantageous further development that the base body comprises at least one retaining web, which extends at a distance from the front side of the housing after the base body has been mounted and can be fixed to at least one of the strip-shaped, tightenable fasteners, where the retaining web has on its underside advantageously an anti-slip, for example, serrated designed, structure. One of the strip-shaped fasteners, which, after mounting, extends around the connecting plug, even in sections, can be attached to this retaining web. The anti-slip, for example, serrated designed, structure on the underside of the retaining web can effectively prevent the strip-shaped fastener, which has been tightened at the retaining web, from slipping out of place.

Advantageously the base body may have a side wall with at least one receptacle, wherein the receptacle is designed to receive a connecting cable of the connecting plug and to secure therein via one of the strip-shaped, tightenable fasteners. With this measure it is possible, for example, to fix a connecting cable, which is connected to an angled connecting plug, to the base body. The receptacle may be designed so as to be V-shaped or U-shaped and may comprise in each case two legs, each of which has an opening. The connecting cable of an electrical connecting plug, which is designed so as to be angled, can be received in this V-shaped or U-shaped receptacle. Then one of the strip-shaped fasteners, for example, a cable tie, is passed through the openings of the two legs of the V-shaped or alternatively U-shaped receptacle and is guided around the connecting cable and then tightened. This measure makes it possible to provide an effective anti-tamper protection for the connecting cable of the respective connecting plug.

BRIEF DESCRIPTION OF THE DRAWINGS

Other features and advantages will become apparent from the following description with reference to the accompanying drawings, which show in.

DETAILED DESCRIPTION

Figure 1:
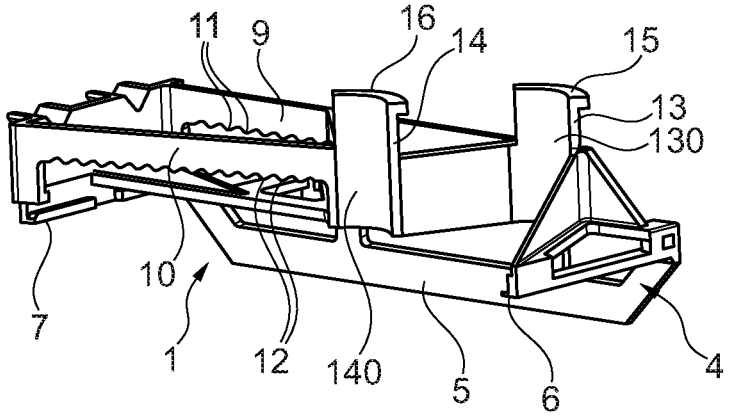
FIG. 1 is a perspective view of a securing apparatus that is intended for mechanically securing at least one connecting plug to a housing of a head module of a control apparatus.
Figure 2:
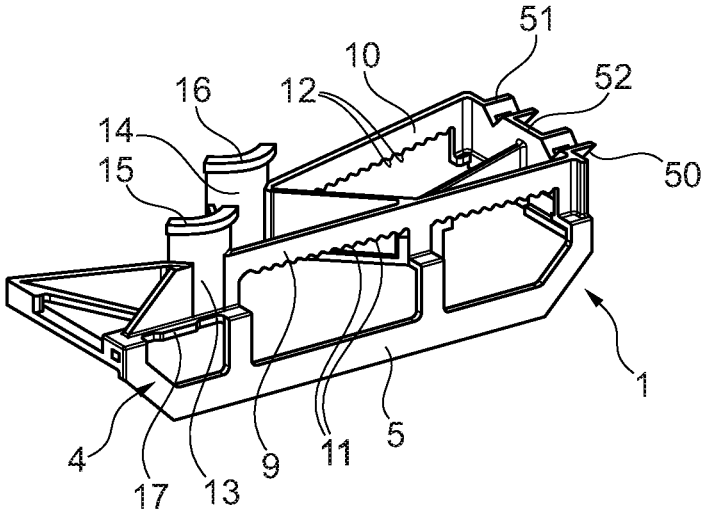
FIG. 2 is another perspective view of the securing apparatus.

A first example of a securing apparatus 1 for mechanically securing at least one connecting plug 2*a*, 2*b* to a housing 3 is explained in greater detail below with reference to FIGS. 1 to 11. In this implementation the housing 3 is a housing 3 of a head module 80 of a modularly constructed control apparatus 90, for example, a safety control apparatus that is designed for controlling a machine or a technical system.

The securing apparatus 1 contains a bow-shaped base body 4, which is made of plastic and which in the present embodiment is formed in one piece and during mounting can be slid laterally onto the housing 3 of the head module 80 and can be fixed to the housing. The base body 4 comprises a connecting cross bar 5 that can be brought to abut against a side wall 30 of the housing 3 during mounting. As can be seen, for example, in FIG. 1, the base body 4 also comprises two retaining rails 6, 7, which extend orthogonally away from the connecting cross bar 5. Owing to the longitudinal extent of the connecting cross bar 5, the two retaining rails 6, 7 are spaced apart from one another such that they can be slid laterally onto the housing 3 during mounting. The housing 3 comprises on its front side 31 a plurality of projections 32, 33, which extend outwards in the opposite direction and which, when the securing apparatus 1 is mounted, engage in the retaining rails 6, 7, which are opposite one another in the base body 4, in order to allow the securing apparatus 1 to be pre-fixed to the housing 3. Details of the mounting of the securing apparatus 1 on the housing 3 can be seen, for example, in FIGS. 9*a* and 9*b*.

Furthermore, the base body 4 contains two retaining webs 9, 10 that are formed and spaced apart from the connecting cross bar 5 such that, after mounting, the retaining webs extend at a distance from the front side 31 of the housing 3. The two retaining webs 9, 10 exhibit on their underside in each case an anti-slip structure 11, 12, which is designed so as to be serrated in the present embodiment, and have a dual function. The two retaining webs are provided, on the one hand, for component stiffening of the securing apparatus 1 and are also used, on the other hand, for the purpose of attaching a strip-shaped, tightenable fastener 40 that can be designed, for example, as a cable tie.

Furthermore, in this example two partially cylindrically shaped receiving sections 13, 14 are formed on the base body 4; and each of the two receiving sections forms an abutment surface 130, 140 for a connecting plug 2*a*, 2*b*. In this example each of the two receiving sections 13, 14 has on a free end a respective collar portion 15, 16, which is designed so as to be partially annular and which comprises advantageously an undercut. The abutment surfaces 130, 140 may have advantageously tolerance-compensating shapes and/or structures that are designed so as to be advantageously elastically deformable, in order to be able to improve in this way the vibration damping as well as to be able to compensate for any differences in the diameter of the electrical connecting plugs 2*a*, 2*b*. Furthermore, two V-shaped receptacles 50, 51, each having two legs, each of which has an opening, are formed on a side wall 52 of the base body 4. A connecting cable 20 of an electrical connecting plug 2*b*, which is designed so as to be angled, can be received in these V-shaped receptacles 50, 51.

Figure 3:
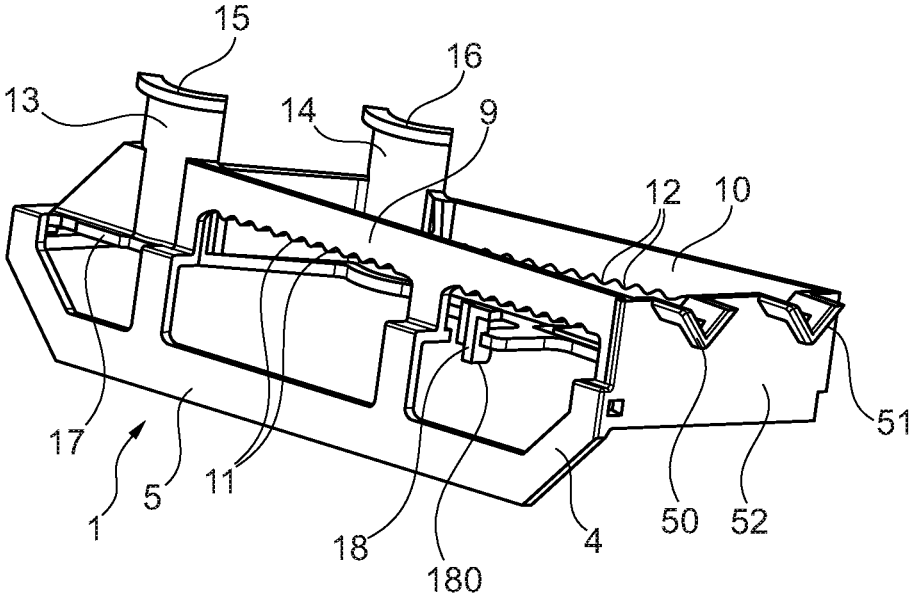
FIG. 3 is an additional perspective view of the securing apparatus.
Figure 4:
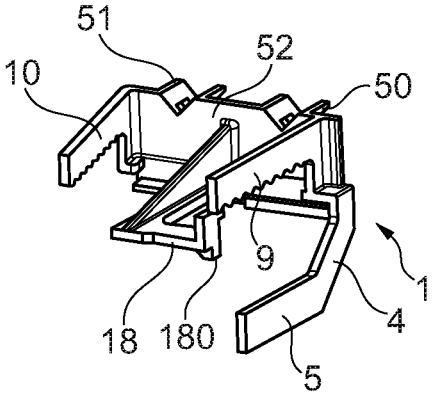
FIG. 4 is a sectional view of the securing apparatus.
Figure 5:
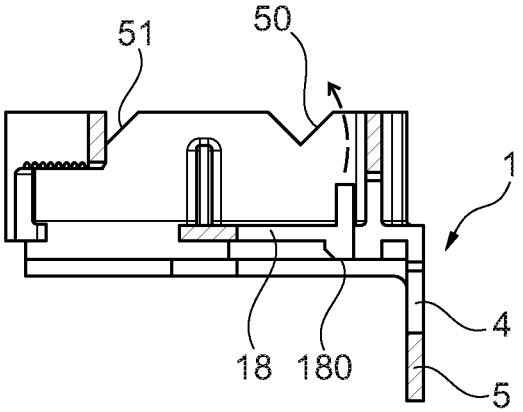
FIG. 5 is a front view of the part of the securing apparatus from FIG. 4.

With reference to FIGS. 3 to 5 the base body 4 comprises on its outside, which faces away from the housing 3 in the desired mounting position, a stop face 17 as well as an elastically pivotable latching pawl 18, on which a latching projection 180 is formed. The direction of pivot of the latching pawl 18 was symbolized by a corresponding arrow in FIG. 5. The stop face 17 and the latching pawl 18 represent two structural measures that are, in principle, independent of one another, in order to protect the securing apparatus 1 against an accidental loss after the securing apparatus has been pre-mounted on the housing 3 of the head module 80, wherein the pre-mounting can take place, for example, at the manufacturer. The stop face 17 and the latching pawl 18 may be combined with one another, as a function of the structural design and shaping of the base body 4, and, in addition, can also be varied in their number and position.

Other details of the anti-loss protection that can be implemented by the stop face 17 and the latching pawl 18 will be explained in more detail below.

Figure 6:
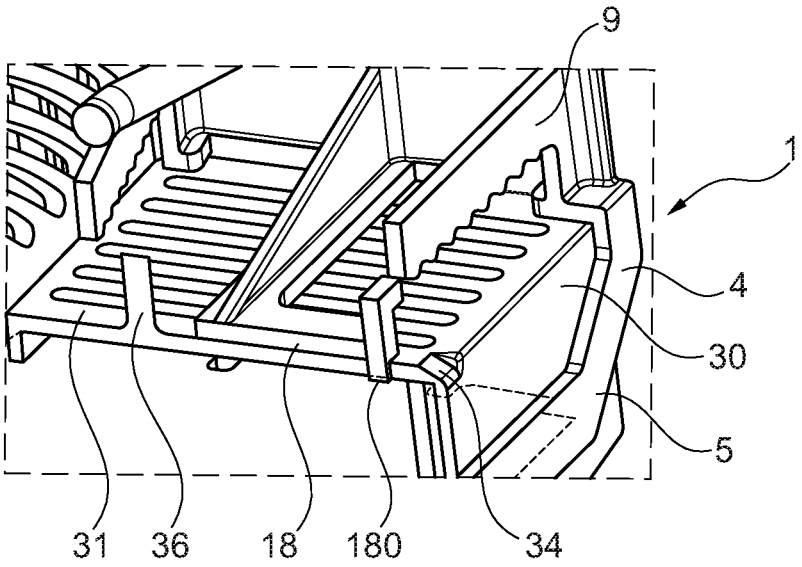
FIG. 6 is a sectional view after the securing apparatus has been mounted on the housing.
Figure 7:
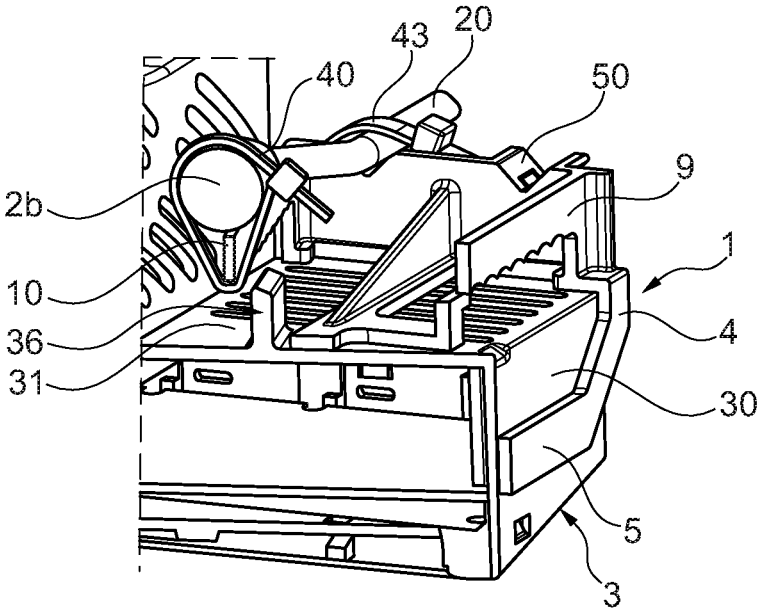
FIG. 7 is another sectional view after the securing apparatus has been mounted on the housing.
Figure 10:
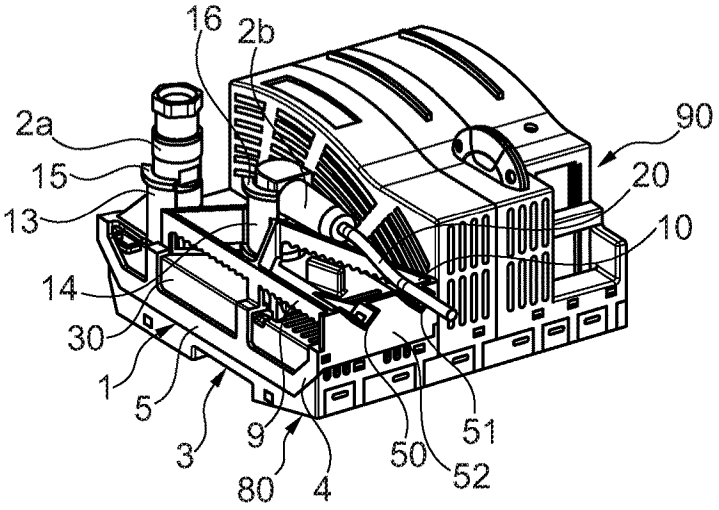
FIG. 10 is a perspective view of the control apparatus after the securing apparatus has been mounted on the housing of the head module.
Figure 8:
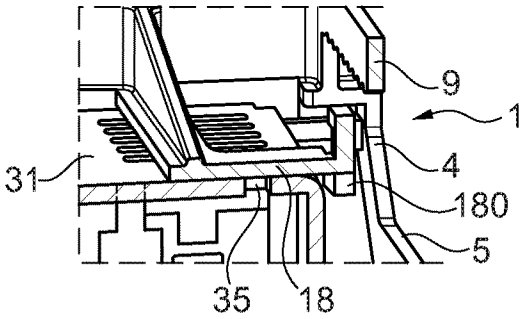
FIG. 8 is a detail that shows the latching of the securing apparatus to the housing.
Figure 9A:
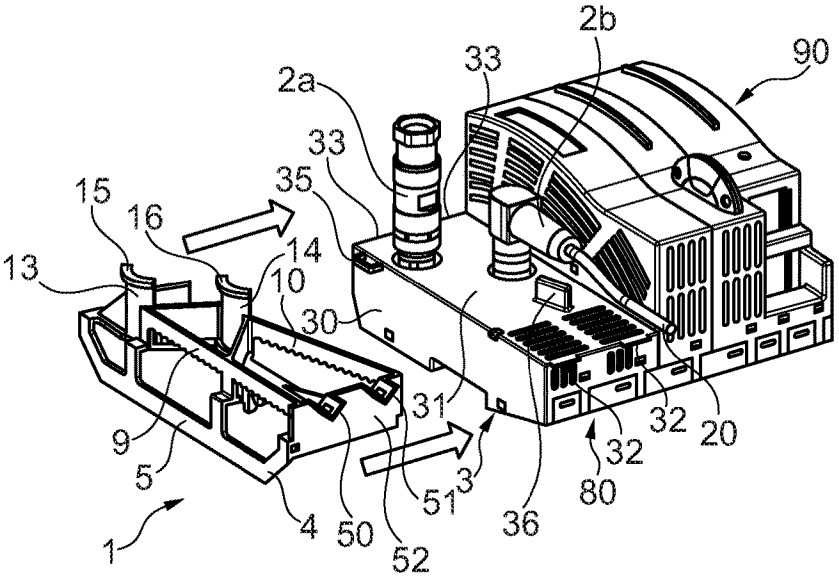
FIG. 9*a* is a perspective view that shows the securing apparatus mounted on the housing of the head module.
Figure 9B:
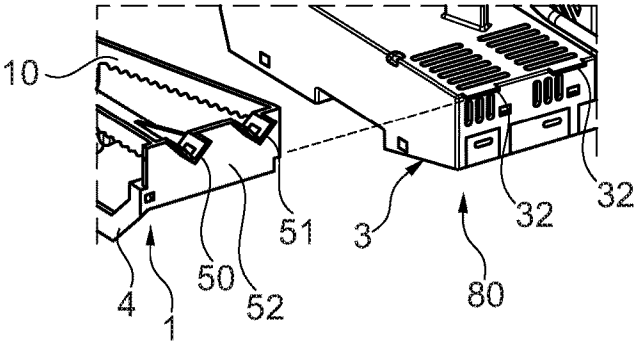
FIG. 9*b* is an enlarged view that shows the details of the mounting of the securing apparatus.
Figure 11:
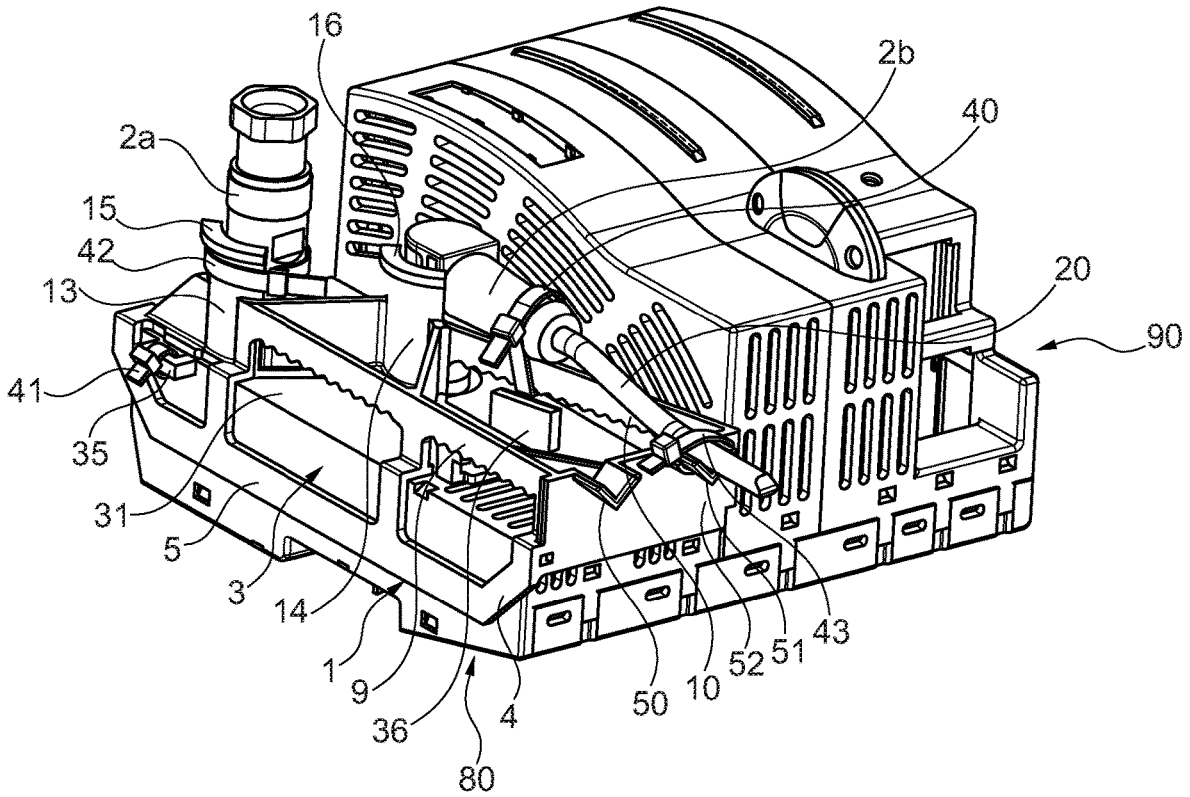
FIG. 11 is a perspective view of the control apparatus with two connecting plugs that are mechanically secured to the housing.

As can be seen in FIG. 6, the housing 30 has on its front side 31 a lead-in chamfer 34 that is designed such that the latching projection 180 of the latching pawl 18 can slide along the lead-in chamfer 34 during mounting, so that the latching pawl 18 is elastically deformed and is pivoted in the direction symbolized by the arrow in FIG. 5. Furthermore, the housing 3 has on its front side 31 a latching recess 35, into which the latching projection 180 of the latching pawl 18 snaps after the securing apparatus 1 has been slid onto the housing 3 in the desired mounting position. Details of the latching pawl 18 with its latching projection 180 as well as the latching recess 35 of the housing 3 are shown in FIG. 8. As can be seen in FIG. 7, a web 36, the function of which will be explained in more detail further below, is also formed on the front side 31 of the housing 3.

With reference to FIG. 9*a* to FIG. 11 additional details of the mounting of the securing apparatus 1 are explained in more detail below.

During mounting, the securing apparatus 1 slides laterally onto the housing 3 such that the outwards extending projections 32, 33 on the front side 31 of the housing 3 engage in the retaining rails 6, 7, which are opposite one another in the base body 4 of the securing apparatus 1. Then as the sliding-on movement of the securing apparatus 1 continues, the latching projection 180 of the latching pawl 18 snaps into the latching recess 35 of the housing 3 in the desired mounting position of the securing apparatus 1. In the desired mounting position the connecting cross bar 5 is located on the side wall 30 of the housing 3. Furthermore, the abutment surfaces 130, 140 of the receiving sections 13, 14 abut against the electrical connecting plugs 2*a*, 2*b* in the desired mounting position.

In the present embodiment a first connecting plug 2*a* is designed as a straight plug, for example, as an M12 plug. In contrast, a second plug 2*b* is designed as an angled plug, for example, as an M12 plug. The securing apparatus 1 is designed structurally such that it can secure two straight connecting plugs 2*a*, two angled connecting plugs 2*b* or, as shown in this example, a straight connecting plug 2*a* and an angled connecting plug 2*b* and, in so doing, can provide effective protection against vibration and tampering. In addition to M12 plugs, other types of plugs that are designed so as to be straight or angled can also be secured via the securing apparatus 1.

On the side wall 30 of the housing 3 there is formed a receiving eye 35, in which a strip-shaped, tightenable fastener 41, for example, a cable tie, is received after the securing apparatus 1 has been attached to the housing 3. During mounting, the strip-shaped fastener 41 is passed through the receiving eye 35 and then tightened. The stop face 17 strikes against the fastener 41, which is mounted on the housing 3 in the manner described above and, thus, prevents the securing apparatus 1 from being removed from the housing 3, so that the result is a corresponding anti-loss protection for the securing apparatus 1.

In order to mechanically secure the first connecting plug 2*a* (in the present embodiment the straight connecting plug), which is inserted into a corresponding connecting socket of the housing 3 of the head module 80, there is provided an additional strip-shaped, tightenable fastener 42, which is also designed advantageously as a cable tie. This fastener 42 is guided around the first receiving section 13 and around the first connecting plug 2*a* and then tightened, so that a respective anti-vibration and anti-tamper protection for this first connecting plug 2*a* in its mounting position can be provided. In this case the collar 130 of the first receiving section 13 makes possible a reliable fastening of the fastener 42.

In order to secure the second connecting plug 2*b*, which is designed so as to be angled in this example and which abuts against the second receiving section 14 of the base body 4, two strip-shaped, tightenable fasteners 40, 43, which are also designed advantageously as cable ties, are also used in the present embodiment. During mounting, a first strip-shaped, tightenable fastener 40 is guided around the connecting plug 2*b* and around the second retaining web 10 and then tightened. The anti-slip, for example serrated, structure 12 on the underside of the second retaining web 10 lends itself to effectively prevent the first strip-shaped fastener 40 from an undesired slipping out of place after mounting and tightening. A connecting cable 20, which is connected to the second connecting plug 2*b*, is inserted into the V-shaped receptacle 51. Then the second strip-shaped, tightenable fastener 43 is passed through the openings of the two legs of the V-shaped receptacle 51, guided around the connecting cable 20 and tightened. Owing to these aforementioned measures an effective anti-tamper and anti-vibration protection is also provided for the second connecting plug 2*b*. The web 36 on the front side 31 of the housing 3 is shaped and dimensioned such that it forms an additional stop that prevents the securing apparatus 1 from being pulled off or, more specifically, disengaged when the first strip-shaped, tightenable fastener 40 for the second connecting plug 2*b* is mounted. In the event of an attempt to pull the securing apparatus 1 off of the housing 3, the fastener 40 strikes against the web 36, so that the web 36 forms an additional anti-loss and/or anti-tamper protection.

The securing apparatus 1 is designed such that the mechanical attachment to the housing 3 of the head module 80, where the mechanical attachment is implemented via the retaining rails 6, 7, is as far away as possible from the electrical connecting interfaces, in which the connecting plugs 2*a*, 2*b* are received. As a result, the torsion resistance of the securing apparatus 1 is improved. Furthermore, the connecting interfaces and soldering points inside the housing 3 are mechanically relieved of strain.

A securing apparatus 200, which is designed in accordance with a second example, shall be explained in more detail below with reference to FIGS. 12 and 13. The securing apparatus 200, which is configured for securing a connecting plug 2*a*, 2*b*, comprises an integrally formed base body 200 that is made of plastic and has a first connecting leg 201 and a second connecting leg 202, both of which are spaced apart from one another at their ends via an interspace 209.

The two connecting legs 201, 202 have in each case a connecting surface, with which the connecting legs rest on a front side 31 of the housing 3 in a desired mounting position. As can be seen in FIG. 13, two latching projections 205, 206, which are spaced apart from one another and which have an inverted T-shaped cross section, are formed on the connecting surface of the first connecting leg 201. Above the two connecting legs 201, 202 there are formed two (advantageously bendable) securing sections 207, 208 that are formed such that they can extend in sections laterally around a connecting plug 2*a*, 2*b* of an electrical plug connection.

The housing 3 comprises on its front side 31 a plurality of recesses, in which the two latching projections 205, 206 of the first connecting leg 201 of a securing apparatus 200 can be received in pairs and can be fixed in the recesses by a sliding movement. After having been mounted on the housing 3, the first connecting leg 201 forms a leg, which is rigidly mounted on the housing, whereas the second connecting leg 202 can be moved relative to the first connecting leg 201.

A first, straight designed, connecting plug 2*a*, which is advantageously an M12 plug, is inserted into a corresponding connecting socket, which is formed inside the housing 3. During mounting, the second connecting leg 202 is spread relative to the first connecting leg 201 so far apart that the connecting cable 20 can be passed through the interspace 209. Then the latching projections 205, 206 are inserted into the associated latching recesses on the front side of the housing 3 and displaced such that they are fixed in the latching recesses. Advantageously the latching connections, formed by the latching projections 205, 206 and the latching recesses of the housing 3, are designed such that they can be disengaged only by a special tool.

Each of the two connecting legs 201, 202 have two openings 210, 211, 212, 213, which are shaped in the manner of an oblong hole in the present embodiment. The two securing sections 207, 208 also have two openings 214, 215, 216, 217. As can be seen in FIG. 12, a first strip-shaped, tightenable fastener 218, for example, a cable tie, is passed through the mutually opposite front openings 210, 212 of the two connecting legs 201, 202 and then tightened. This first strip-shaped fastener 218 prevents the securing apparatus 200 from being able to move back and forth and, for example, prevents it from being able to be demounted from the housing 3. A second strip-shaped, tightenable fastener 219, which is also designed advantageously as a cable tie, is passed through the mutually opposite rear openings 215, 217 of the securing sections 207, 208 and guided around the first connecting plug 2*a* and then tightened. This second strip-shaped fastener 219 forms an anti-vibration protection for the first connecting plug 2*a* in that it can absorb the corresponding forces. Furthermore, the second strip-shaped fastener 219 can effectively prevent the first connecting plug 2*a* from being unscrewed or rather pulled off out of the connecting socket of the housing 3 of the head module 80.

Figure 12:
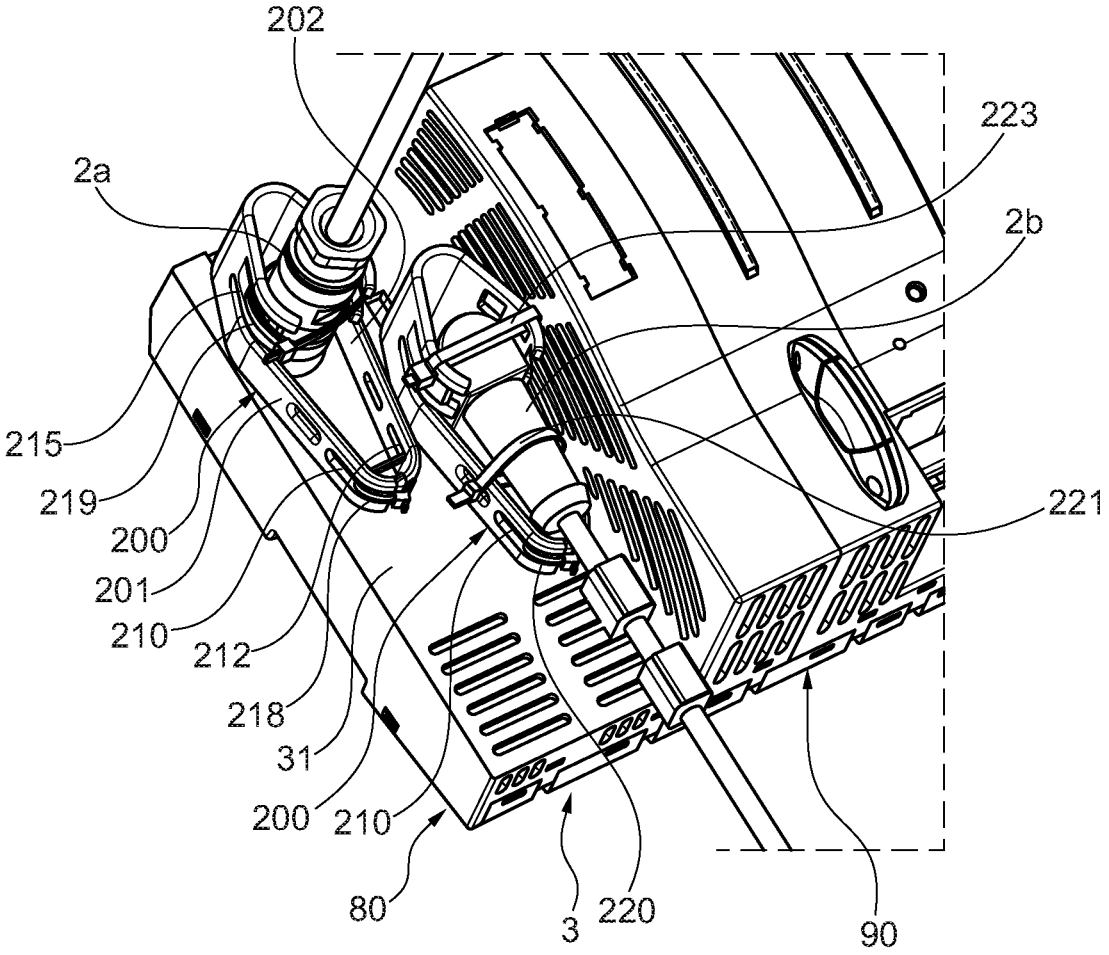
FIG. 12 is a perspective view of a housing and a securing apparatus, mounted on the housing, in accordance with a second example.
Figure 13:
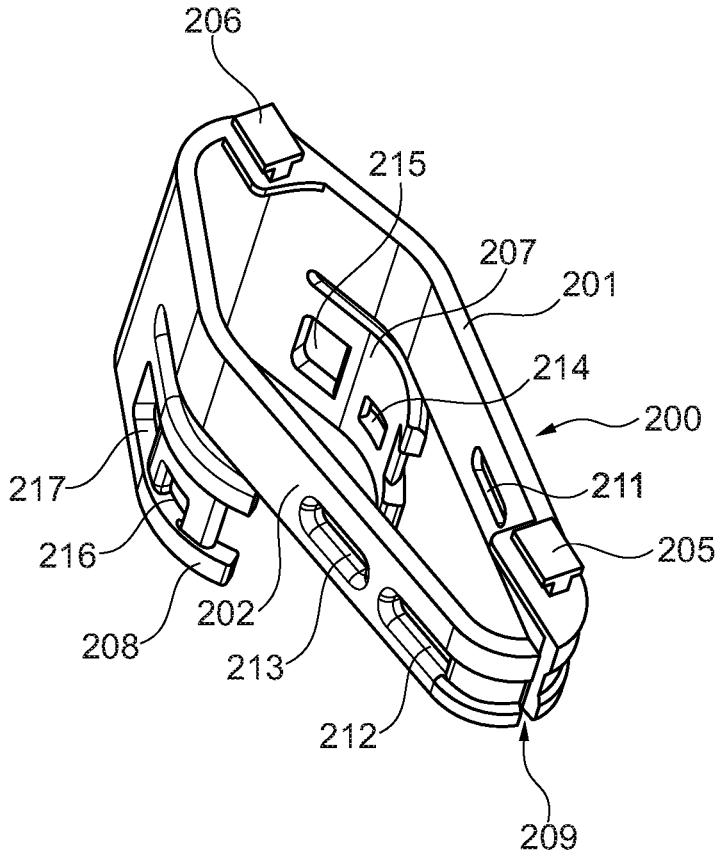
FIG. 13 is a bottom view of the securing apparatus from FIG. 12.

In addition, FIG. 12 also shows the mechanical securing of a second connecting plug 2*b*, which is designed as an angled plug, for example, an M12 plug, in the present embodiment. A first strip-shaped, tightenable fastener 220, for example, a cable tie, is passed through the mutually opposite front openings 210, 212 of the two connecting legs 201, 202 of the securing apparatus 200, which is also mounted on the housing 3 in the manner described above, and then tightened. This first strip-shaped fastener 220 in turn prevents the securing apparatus 200 from being able to move back and forth and, for example, prevents it from being able to be disengaged from the housing 3. A second strip-shaped, tightenable fastener 221 is passed through the mutually opposite rear openings 211, 213 of the two connecting legs 201, 202, is guided around the second connecting plug 2*b* and then tightened. As a result, an effective anti-vibration protection is provided in that the corresponding forces, acting on the second connecting plug 2*b*, are absorbed.

In addition, there is the option that a third strip-shaped, tightenable fastener 223 can be passed through the mutually opposite front openings 214, 216 of the two securing sections 207, 208, guided along an outside of the second connecting plug 2*b* and then tightened, in order to provide in this way an additional anti-tamper protection.

What is claimed is:

1. A securing apparatus for mechanically securing at least one connecting plug to a housing, said securing apparatus comprising;

a bow-like shaped base body comprising two retaining rails that extend parallel to one another and that are spaced apart from one another, wherein said bow-like shaped base body and rails can slide laterally onto the housing during mounting, and be fixed to said housing, at least one receiving section, formed on the bow-like shaped base body, the at least one receiving section configured to receive the connecting plug, and a plurality of strip-shaped, tightenable fasteners, which are capable of securing the connecting plug to the bow-like shaped base body and/or the bow-like shaped base body to the housing, wherein when the securing apparatus is mounted to the housing, the retaining rails receive projections formed on a front side of the housing and extending outwards in an opposite direction.

2. The securing apparatus of claim 1, wherein the receiving section is partially cylindrical and has an abutment surface for the connecting plug.

3. The securing apparatus of claim 2, wherein the abutment surface comprises tolerance-compensating shapes and/or structures that are elastically deformable.

4. The securing apparatus of claim 2, wherein the receiving section has a collar portion on a free end, wherein said collar portion is partially annular.

5. The securing apparatus of claim 4, wherein said collar portion has an undercut.

6. The securing apparatus of claim 1, wherein the base body comprises an elastically pivotable latching pawl that engages a latching recess on a front side of the housing upon mounting to the securing apparatus.

7. The securing apparatus of claim 1, wherein the base body comprises a stop face that faces away from the housing during mounting, wherein said stop face interacts in an adjustable manner with a strip-shaped tightenable fastener of the plurality of strip-shaped, tightenable fasteners that is received in a receiving eye in a side wall of the housing.

8. The securing apparatus of claim 1, wherein the base body comprises at least one retaining web having an underside, the retaining web being spaced apart from the front side of the housing when the base body is mounted, and the retaining web configured to receive a strip-shaped, tightenable fastener of the plurality of strip-shaped, tightenable fasteners, wherein the retaining web has an anti-slip structure on the underside.

9. The securing apparatus of claim 8, wherein said anti-slip structure of the retaining web is a serrated structure.

10. The securing apparatus of claim 1, wherein the base body comprises a side wall having at least one receptacle designed to receive a connecting cable of a connecting plug secured by the strip-shaped, tightenable fastener.

11. The securing apparatus of claim 1 further comprising said housing, wherein said housing is a housing of a head module of a modular control apparatus.

* * * * *